US006041852A

United States Patent [19]

Sato et al.

[11] Patent Number: 6,041,852

[45] Date of Patent: Mar. 28, 2000

[54] CONDENSER

[75] Inventors: Kenji Sato, Hiratsuka; Akihiro Taniguchi; Shin Ohgushi, both of Yokohama, all of Japan

[73] Assignee: Kabushiki Kaisha Toshiba, Kawasaki, Japan

[21] Appl. No.: 08/764,913

[22] Filed: Dec. 13, 1996

[30] Foreign Application Priority Data

Dec. 15, 1995 [JP] Japan ..... 7-327266
Apr. 8, 1996 [JP] Japan ..... 8-085073

[51] Int. Cl.[7] ..... F28B 3/00

[52] U.S. Cl. ..... 165/114; 165/111; 165/112

[58] Field of Search ..... 165/111, 110, 165/114, 113, 112

[56] References Cited

U.S. PATENT DOCUMENTS

| | | | |
|---|---|---|---|
| 1,332,188 | 2/1920 | Ehrhart et al. | 165/114 |
| 1,406,356 | 2/1922 | Ehrhart | 165/114 |
| 2,162,871 | 6/1939 | Tuley et al. | 165/114 |
| 2,196,641 | 4/1940 | Morgan | 165/111 X |
| 3,094,165 | 6/1963 | Droescher | 165/111 |
| 3,520,521 | 7/1970 | Heller et al. | 165/114 |
| 4,967,833 | 11/1990 | Blangetti et al. | 165/114 |
| 5,018,572 | 5/1991 | Blangetti et al. | 165/114 X |
| 5,154,227 | 10/1992 | Csaba et al. | 165/114 X |
| 5,465,784 | 11/1995 | Blangetti et al. | 165/114 |

FOREIGN PATENT DOCUMENTS

| | | | |
|---|---|---|---|
| 0020003 | 2/1978 | Japan | 165/114 |
| 53-118606 | 10/1978 | Japan . | |
| 0140787 | 6/1986 | Japan | 165/111 |
| 0561066 | 6/1977 | U.S.S.R. | 165/114 |
| 0901793 | 1/1982 | U.S.S.R. | 165/111 |

*Primary Examiner*—Christopher Atkinson
*Attorney, Agent, or Firm*—Foley & Lardner

[57] ABSTRACT

The present invention provides a condenser which is free from pressure loss of air stream due to an air exhaust pipe and loss of thermal energy, and which is compact. In the condenser according to the present invention, deflector plates 27*b* are disposed in a vertically central part of a first cooling pipe bundle having a number of cooling pipes extended in parallelism with each other and in a first horizontal direction of the condenser. The deflector plates 27*b* are diverged downward to both sides and provide a roof of air cooling chambers 24*a*, 24*b*. Second cooling pipe bundles 25*a*, 25*b* are disposed respectively in the air cooling chambers 24*a*, 24*b*. An air exhaust inner pipe 29 is extended upward in the first cooling pipe bundle 20 in communication with upper spaces 34*a*, 34*b* in the air cooling chambers 24*a*, 24*b*.

15 Claims, 11 Drawing Sheets

CONDENSER

BACKGROUND OF THE INVENTION

The present invention relates to a condenser for condensing exhaust steam of steam turbines of thermal power plants and atomic power plants.

Generally in a steam turbine plant, steam which has worked in a steam turbine and inflated is condensed by a surface contact type-condenser for recovery.

FIG. 11 is a sectional view of one example of the above-described condenser. In a condenser body 1 into which exhaust discharged from the steam turbine not shown there are disposed cooling pipe bundles 2 of a number of cooling pipes which are extended in a first direction (which is perpendicular to the sheet of FIG. 11) and in parallelism with each other, whereby the exhaust from the steam turbine is heat-exchanged with cooling water, such as sea water, river water or others, on the surfaces of the respective cooling pipes and condensed to be drained.

Each cooling pipe bundle 2 is divided in a plurality of pipe groups 2*a*, 2*b*, 2*c*, 2*d*, 2*e*, and the pipe groups are defined by partition plates 3, 4 so that the heat conducting pipe groups do not affect by the drain the heat-exchange of the other heat conducting pipe groups. Air cooling pipe groups for condensing residual energy of the steam 6, 7 are provided below the cooling pipe bundle 2. Partition plates 5*a*, 5*b* are provided between the cooling pipe bundle 2 and the pipe groups 6, 7 respectively. Gas discharging devices 8, 9 are provided respectively on the sides of the air cooling pipe groups 6, 7. Enclosure plates 10, 11 are provided respectively below the air cooling pipe groups 6, 7, and a sprinkler box 12 having a U-seal is provided between the enclosure plates 10, 11 and therebelow.

Drain thus heat-exchanged and condensed by the cooling pipe bundle 2 as the steam flows is collected at the center of the pipe bundle 2 and flows into the below sprinkler box 12 through between the air cooling pipe groups 6, 7 enclosed by the enclosing plates 10, 11, then falls through the U-seal into a hot well 13 which is a lowermost part of the condenser body 1 and discharged outside through a drain exit 14.

On the other hand, uncondensed gases, such as steam which could not be condensed by the cooling pipe bundle 2, air, etc. flows through the air cooling pipe groups 6, 7 horizontally toward the outside of the condenser body to be discharged to the outside of the condenser body 1 through an air exhaust pipe 15 via the gas discharging devices 8, 9.

Because the air exhaust pipe 15 is connected to the outside of the air cooling pipe groups 6, 7 as described above, drain generated in the air cooling pipe groups 6, 7 tends to intrude the air exhaust pipe 15. For the purpose of prohibiting the drain intruding the air exhaust pipe 15 as described above from residing in the air exhaust pipe to return to the sprinkler box 12, the air exhaust pipe includes a vertical piping or an inclined piping portion to lead the uncondensed gas upward, whereby exhaust of the uncondensed gas is smoothed, and downstream machines and instruments are protected from erosion and corrosion. Accordingly it is necessary to arrange the air exhaust pipe extended upward along the sides of the cooling pipe bundle 2.

The drain once intruded the air exhaust pipe is sometimes carried against the gravity by the uncondensed gas in the air exhaust pipe when the uncondensed gas has a high flow rate. In addition, pressure loss increase much affects achievement of the condenser. Accordingly, thick pipes are used for low flow rates.

However, the sides of the cooling pipe bundle 2 are places where the steam which has flowed from upward flows into the cooling pipe bundle 2. In these places the flow passage has a most restricted area by the cooling pipe bundles 2, and the steam has a highest flow rate.

Accordingly it causes pressure loss increase to dispose the air exhaust pipe 15, which is to be a barrier, in such a high flow rate area. As a result of that, the outlet pressure increase of the turbine occurs. Resultant problems are that effective use of thermal energy is affected, and others. The air exhaust pipes 15 must be arranged extended between the cooling pipe bundles and between the cooling pipe bundle and the condenser body, which results in the increased width of the bottom of the condenser body 1. Problems are that the condenser cannot be compact, and others.

In view of the above-described problems, the present invention was made, and an object of the present invention is to provide a condenser which can prevent pressure loss of steam flow due to the air exhaust pipe, prevent thermal energy loss, and can be compact.

SUMMARY OF THE INVENTION

The object of the present invention is achieved by a first characteristic that a condenser comprises a condenser body; a first cooling pipe bundle having a number of cooling pipes extended horizontally and disposed in the condenser body; a pair of deflector plates disposed at a substantially central part of the first cooling pipe bundle, and diverged downward to both sides, the pair of deflector plates defining an air cooling portion therebelow; a pair of second cooling pipe bundles, each having a number of cooling pipes extended in the first direction of the condenser body and so disposed that an upper space is defined between the second cooling pipe bundle and the deflector plate within the air cooling portion, the second cooling pipe bundles defining a gap therebetween; and an air exhaust inner pipe extended vertically in the first cooling pipe bundle, having one end communicated with the upper spaces within the air cooling portion and the other end communicated with the outside of the body of the condenser.

The object of the present invention is achieved by a second characteristic that the condenser further comprises short pass preventive plates covering the gap between the bisections of the first cooling pipe bundle and extended in the cooling pipe bundle, for preventing steam from directly intruding a vicinity of the air cooling chambers through the gap.

According to the present invention, the air exhaust pipe can be disposed on the top or the bottom of the cooling pipe bundle, and it is unnecessary to dispose the air exhaust pipe on both sides of the cooling pipe bundle where steam increases flow rate, whereby thermal energy due to pressure loss of steam flow can be prevented, and the condenser can be compact. The provision of the short pass preventive plates in the central space in the cooling pipe bundle can prevent short pass of steam into the cooling pipe bundle, which improve heat conduction achievement.

DETAILED DESCRIPTION OF THE INVENTION

A first embodiment of the present invention will be explained with reference to the drawings attached hereto.

Figure 1:
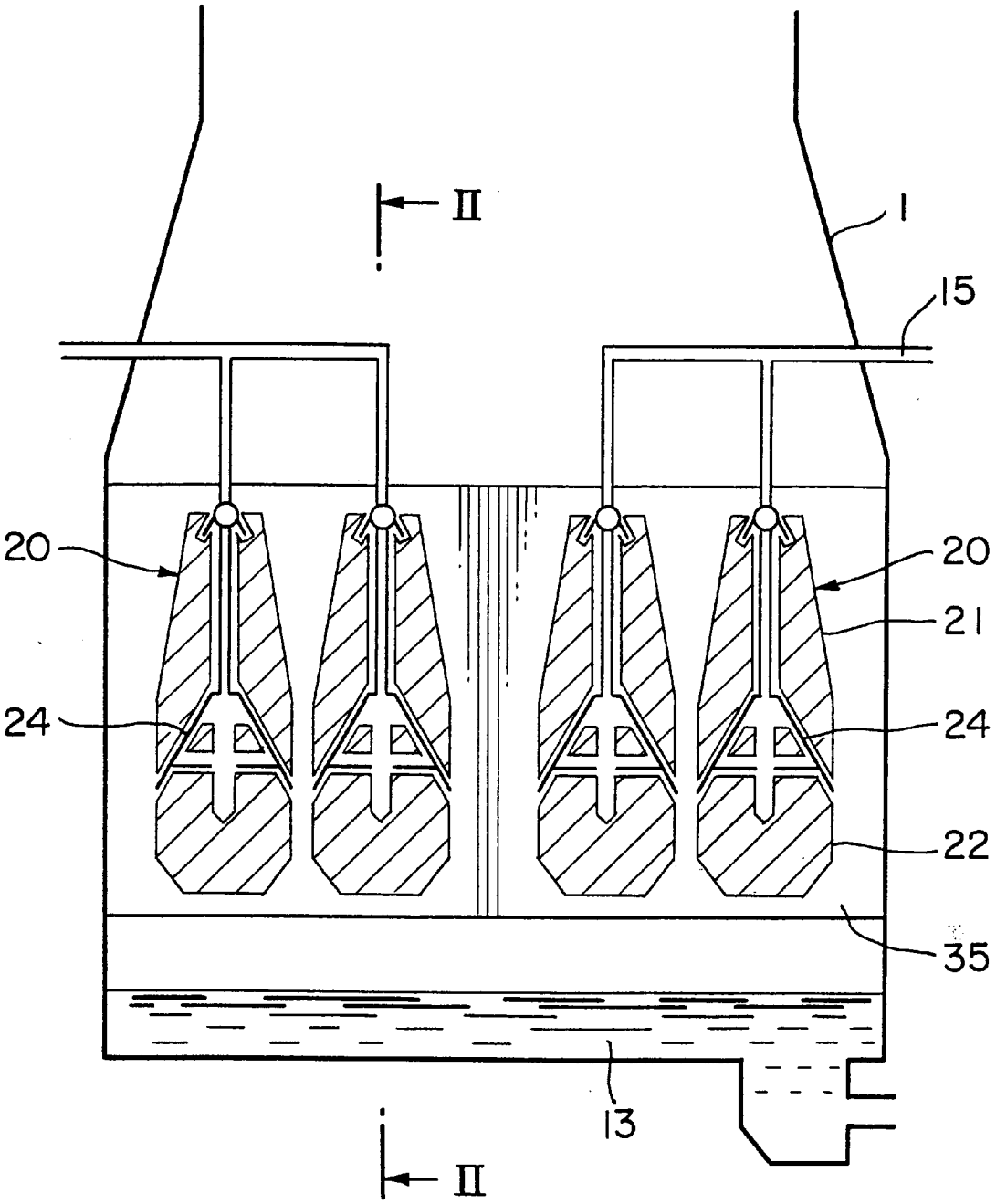
FIG. 1 is a vertical sectional view of the condenser according to a first embodiment of the present invention.
Figure 2:
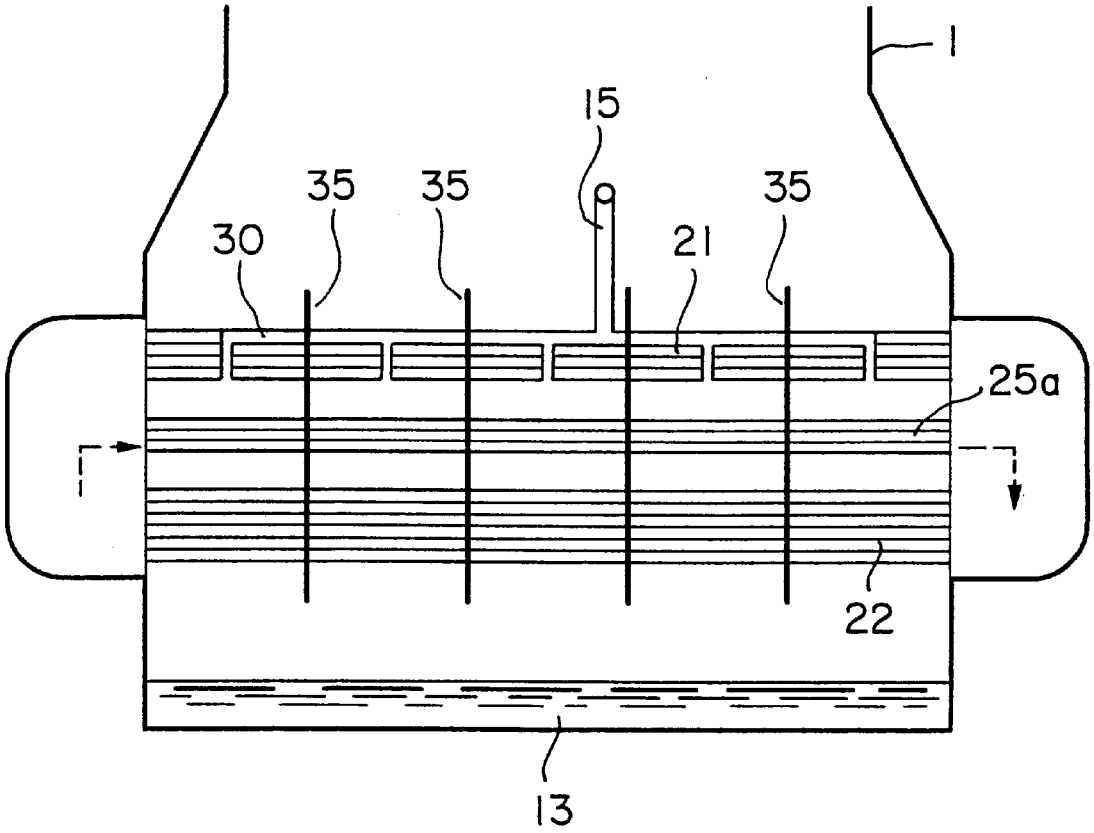
FIG. 2 is a sectional view of the line II—II in FIG. 1.

As shown in FIGS. 1 and 2, a plurality of first cooling pipe bundles 20 are extended in a first horizontal direction (a direction perpendicular to the sheet of the drawing) and disposed side by side with each other in the body 1 of a condenser. Each first cooling pipe bundle 20 is supported by support plates 35 which are positioned at a certain pitch in the first horizontal direction. The support plates 35 divide the first cooling pipe bundle 20 in a plurality of sections. A hot well 13 is formed below the first cooling pipe bundles 20.

Figure 3:
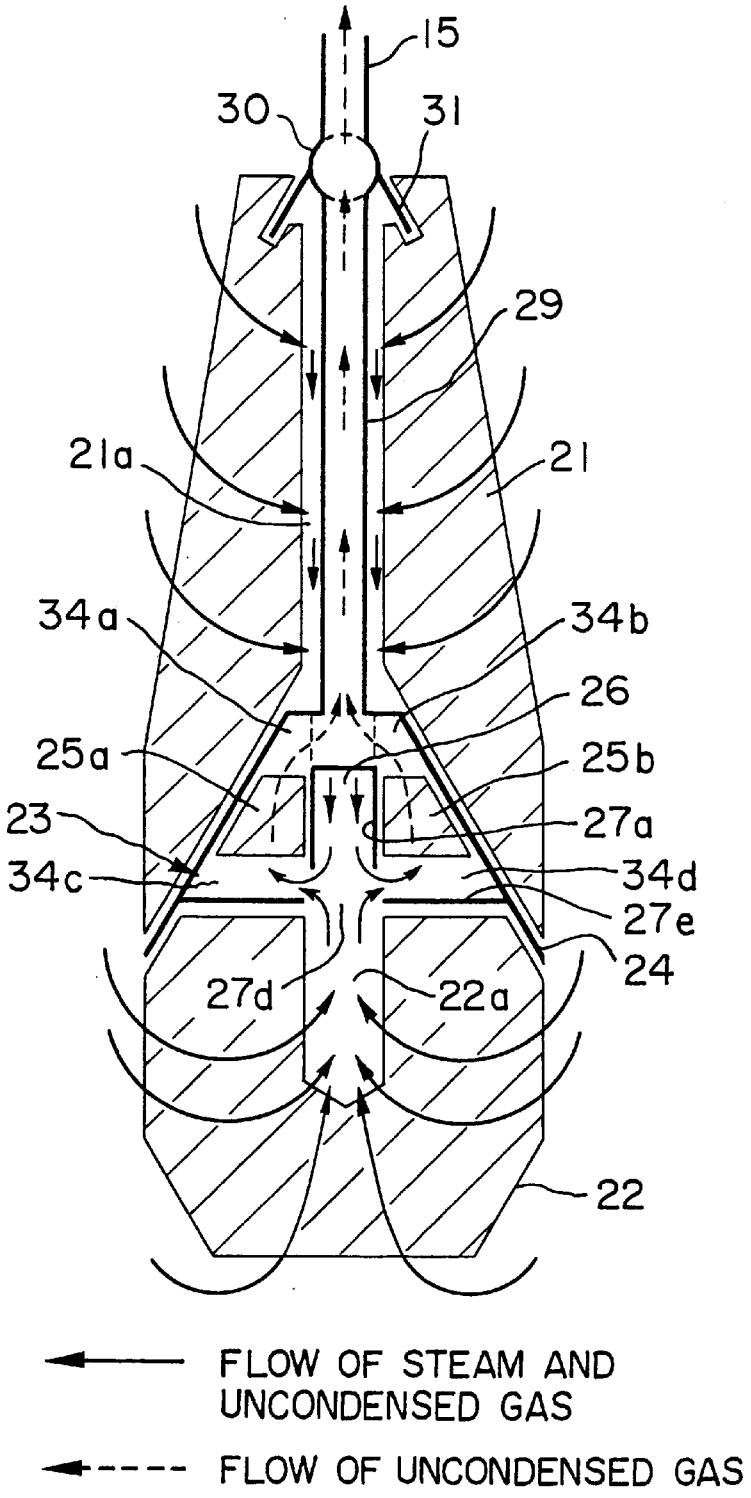
FIG. 3 is a sectional view of a cooling pipe bundle of the condenser of FIG. 1.

Especially shown in FIG. 3, each first cooling pipe bundle 20 includes an upper pipe bundle 21 and a lower pipe bundle 22. The upper pipe bundle 21 has a configuration whose horizontal width is increased from the upper end to the lower end, and a space 23 whose width is decreased upward is formed on the lower end of the upper pipe bundle 21. The upper pipe bundle 21 is divided in left and right sections which are symmetric with each other. An upper central space 21*a* is formed between the surfaces of the two sections opposed to each other. The lower pipe bundle 22 has the upper half bisected in a left and a right sections. A lower central space 22*a* is formed between the surfaces of the sections of the lower pipe bundle 22 opposed to each other.

An air cooling portion 24 is formed in the space 23 of the upper pipe bundle 21. The air cooling portion 24 includes air cooling chambers 24*a*, 24*b* having a horizontally symmetric shape and extended in parallelism with each other. Each air cooling chamber is defined by a partitioning element which includes a slant side 27*b* which forms the roof of the air cooling chamber, i.e., a deflector plate, a vertical side 27*a*, a top side interconnecting the vertical side 27*a* and the inclined side 27*b*, a horizontal side 27*e* which is disposed so as to cover the top of the lower cooling pipe bundle 22, and a pair of support plates 35. The slant sides 27*b* on the left and the right sides as viewed in the drawings are so arranged that the lower ends thereof are diverged to the left and the right in conformity with a sectional shape of the space 23. The left and the right vertical sides 27*a* are spaced from each other by a certain gap to define a passage 26 between the air cooling chambers 24*a*, 24*b*.

Second cooling pipe bundles 25*a*, 25*b* for air cooling are disposed respectively in the air cooling chambers 24*a*, 24*b* at vertically substantially middle parts thereof. The air cooling chambers 24*a*, 24*b* are respectively divided in upper spaces 34*a*, 34*b* and lower spaces 34*c*, 34*d* by the second cooling pipe bundles 25*a*, 25*b*. The lower spaces 34*c*, 34*d* are in communication with the passage 26 between the air cooling chambers 24*a*, 24*b* by an opening 27*d*. The upper spaces 34*a*, 34*b*, which are upper parts of the interiors of the air cooling chambers are in communication with one another by a plurality of communication passages 28. The cooling pipes 25*a*, 25*b* are arranged symmetric with each other, and respectively have both ends positioned along the associated slant sides 27*b* and vertical sides 27*a*, making the second cooling pipe bundles 25*a*, 25*b* downwardly convergent. The cooling pipe bundles 25*a*, 25*b* are extended in the body 1 in parallelism with the cooling pipe bundle 20 and supported by the support plates 35.

An air exhaust inner pipe 29 is inserted vertical in the upper central space 21*a* with the lower end communicated with the communication passage 28 of the air cooling portion 24. Especially shown in FIGS. 2 and 3, the air exhaust inner pipes 29 of the respective sections have the top ends communicated with an air exhaust header 30 which is extended in the first horizontal direction.

As shown in FIG. 3, short pass preventive plates 31 are provided on both sides of the air exhaust header 30. The short pass preventive plates 31 are extended outwardly slant on the left and the right sides and projected into the upper pipe bundle 21, covering the upper central space 21*a* of the upper pipe bundle 21.

Thus, steam which has flowed into an upper part of the body 1 flows into the upper cooling pipe bundle 21 formed of a number of cooling pipes as described above and the lower cooling pipe bundle 22. The steam which has flowed into the upper and the lower cooling pipe bundles 21, 22 is cooled by the surface of the heat conducting pipes and condensed into drain while flowing across the cooling pipe bundles. The drain is caused to flow downward by the gravity. The drain which has flowed downward from the upper cooling pipe bundle 21 flows on the slant sides 27*b*, i.e., the deflector plates, and exits the first cooling pipe bundle 20 and falls into the hot well 13.

Drain is generated also in the lower cooling pipe bundle 22 and falls directly into the hot well 13. The drain is sprinkled into the surrounding saturated steam while falling.

Figure 4:
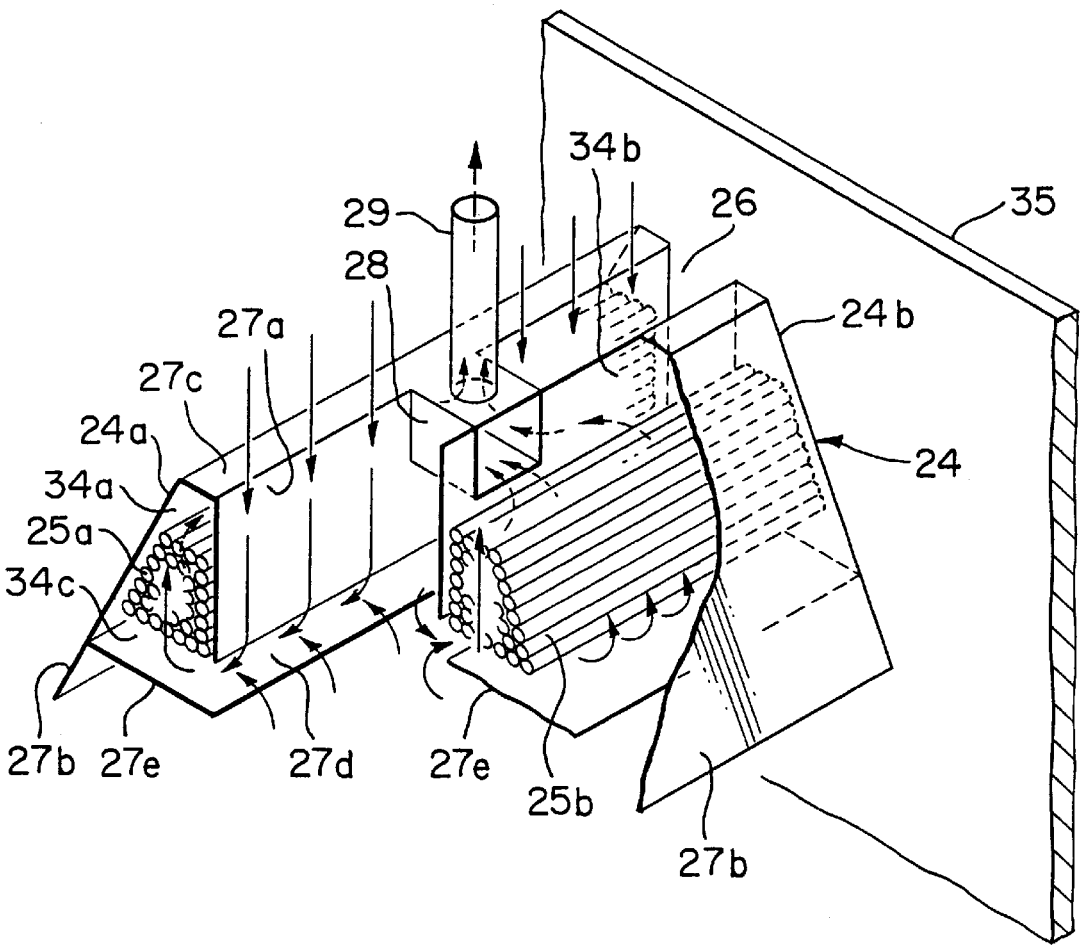
FIG. 4 is a partially broken perspective view of an air cooling portion of FIG. 3.

On the other hand, as indicated by the arrows in FIGS. 3 and 4, steam which passes the cooling pipe bundle into the central part of the pipe bundle 20 is mostly condensed into steam containing high concentration of uncondensed gas, such as air, etc. by the time when the steam enters the central part of the pipe bundle 20. The steam flows downward through the upper central space 21*a* of the upper pipe bundle and then through the passage 26 between the air cooling chambers 24*a*, 24*b*, and flows into the lower spaces 34*c*, 34*d* in the air cooling chambers 24*a*, 24*b* and then upwardly through the second cooling pipe bundles 25*a*, 25*b*, and flows into the upper spaces 34*a*, 34*b*. Steam in the lower pipe bundle 22 flows upward through the lower central space 22*a* and between the horizontal plate 27*e* and flows into the lower spaces 34*c*, 34*d* in the air cooling chambers 24*a*, 24*b* and then upwardly through the second cooling pipe bundles 25*a*, 25*b*, and flows into the upper spaces 34*a*, 34*b*.

While steam passes through the second cooling pipe bundles 25*a*, 25*b*, most of residual steam is condensed, and only uncondensed gas flows into the upper spaces 34*a*, 34*b* as indicated by the dot lines and then flows into the air exhaust pipe 29 through the communication passage 28. The uncondensed gas ascends through the air exhaust pipe 29 to the air exhaust header 30 to be discharged to the outside of the body 1 through the air exhaust pipe 15.

Here, when a large amount of steam makes a short pass into the upper central space 21*a* of the upper cooling pipe bundle 21, pressure increase takes place in the upper central part 21*a* of the upper cooling pipe bundle 21, whereby steam which has flowed in at the periphery of the upper cooling pipe bundle 21 flows to the upper central space 21*a* of the upper cooling pipe bundle 21 at decreased flow rate, and uncondensed gas accumulated in the vicinity of the cooling pipes cannot be quickly discharged. Accordingly heat conduction on the surfaces of the cooling pipes is hindered, and pressure outside the upper cooling pipe bundle 21 rises. Accordingly exhaust pressure of the turbine rises, which hinders effective use of the thermal energy.

In view of this, the short pass preventive plates 31 are provided on both sides of the air exhaust header 30, projected in the upper cooling pipe bundle 21 and covering the upper central space 21*a* formed in the central part of the upper cooling pipe bundle 21, whereby the steam short pass from the sides of the air exhaust header 30 due to pressure difference between the inside and the outside of the upper cooling pipe bundle can be prevented, and the above-described inconvenience can be solved.

In the present invention, uncondensed gas is led upward through the air exhaust inner pipe 29 which is disposed at the central part of the upper cooling pipe bundle 21 and is projected from the top portion of the upper pipe bundle 21. Then the gas is discharged through the air discharge pipe 15 to the outside of the body 1. Thus, it is not necessary to dispose the air exhaust pipes 15 at the areas between the cooling pipe bundles 20; i.e., beside the cooling pipe bundle 20 where steam flow rate increase takes place, and accordingly thermal energy loss due to pressure loss of steam flows can be prevented.

Figure 5:
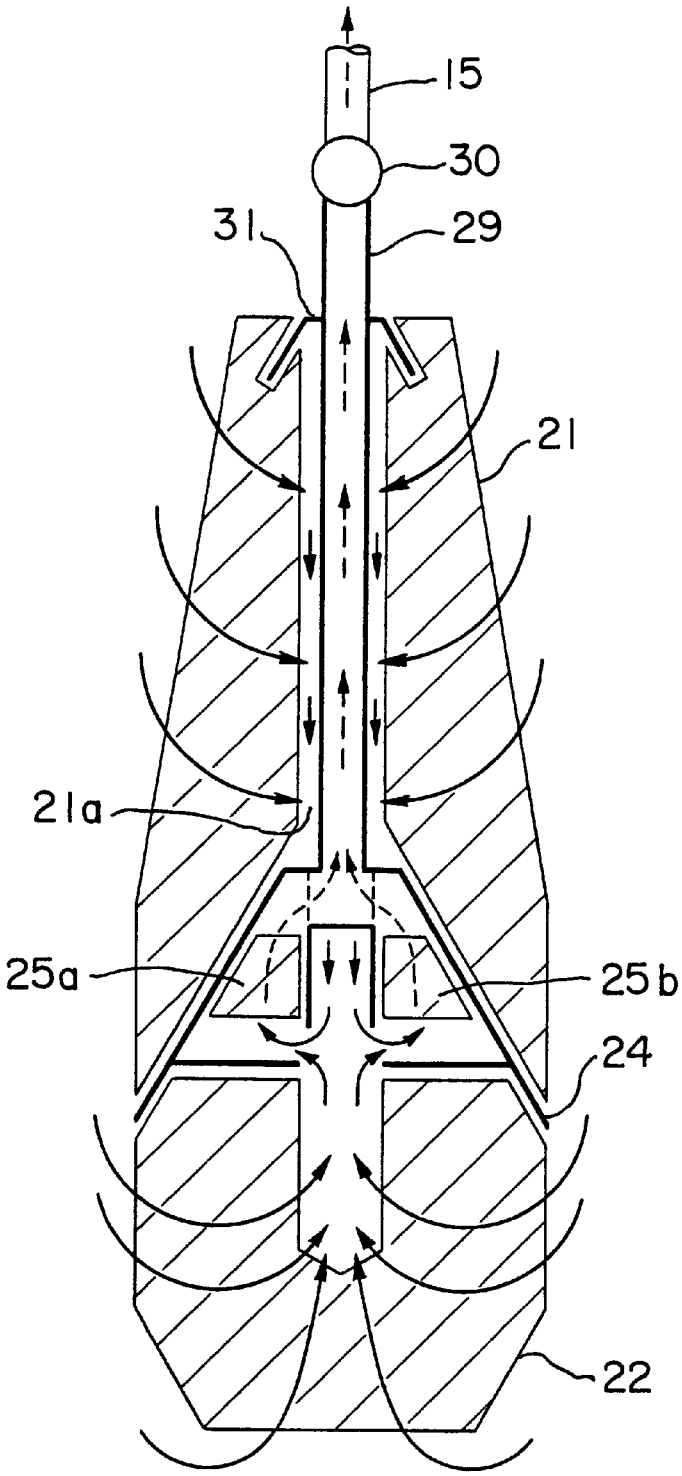
FIG. 5 is a sectional view of a cooling pipe bundle of the condenser according to a second embodiment of the present invention.

FIG. 5 is a sectional view of the condenser according to second embodiment of the present invention. In the present embodiment, the air exhaust inner pipe 29 is upwardly projected above the upper cooling pipe bundle 21 and is communicated with the air exhaust header 30 disposed above the upper cooling pipe bundle 21. The short pass preventive plates 31 are provided on both sides of a portion of the exhaust inner pipe 29 corresponding to the top of the upper cooling pipe bundle 21. That is, the air exhaust inner pipe 29 is passed through the short pass preventive plates 31. In the other respects the present embodiment is the same as the former embodiment, and accordingly the present embodiment produces the same effects as the former embodiment.

Figure 6:
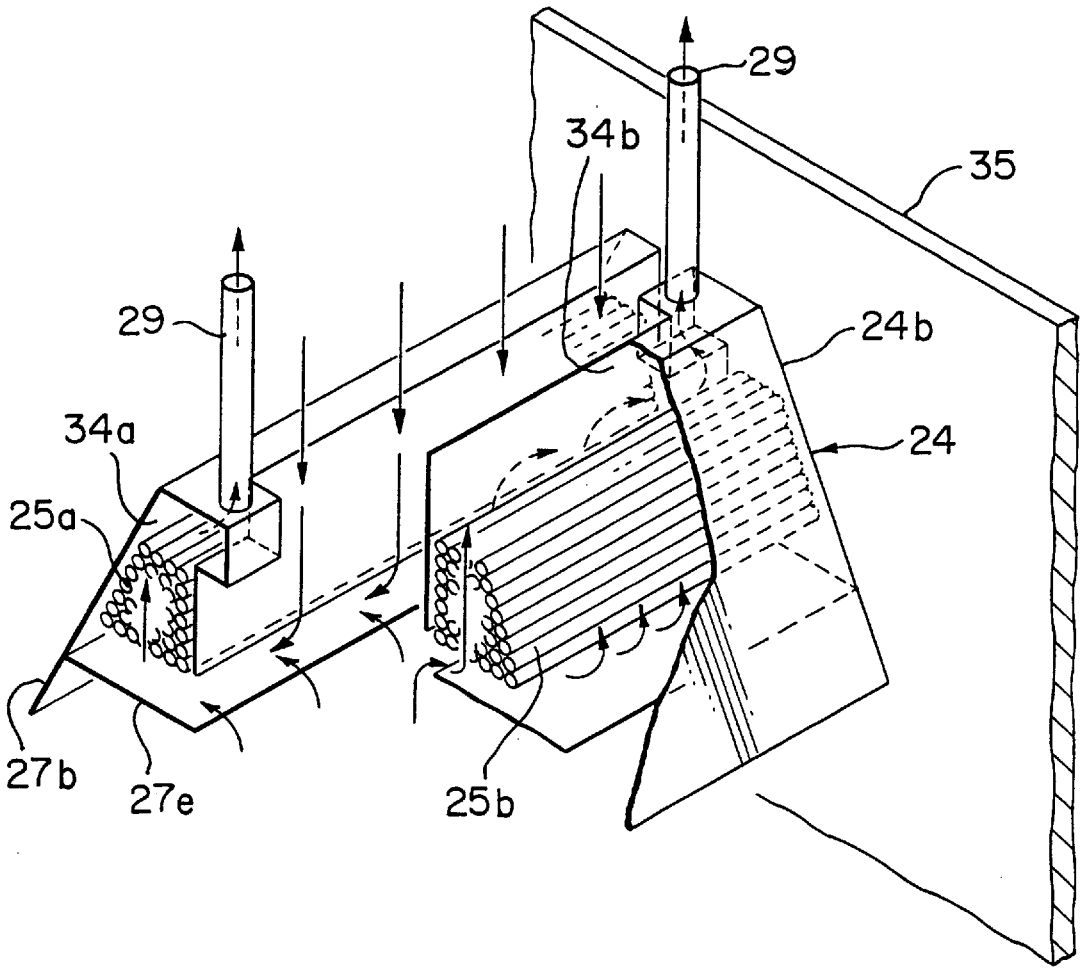
FIG. 6 is a partially broken perspective view of the air cooling portion according to a third embodiment of the present invention.

FIG. 6 is a partially broken perspective view of the air cooling portion 24 of the condenser according to a third embodiment of the present invention. In the present embodiment, the respective air exhaust inner pipes 29 are communicated with the respective upper spaces 34*a*, 34*b* in the interiors of the respective air cooling chambers 24*a*, 24*b*. Uncondensed gas which has passed through the upper cooling pipe bundle is exhausted from the respective upper spaces 34*a*, 34*b* in the left and the right air cooling chambers 24*a*, 24*b* to the air exhaust header 30 upward through the air exhaust inner pipe 29.

Figure 7:
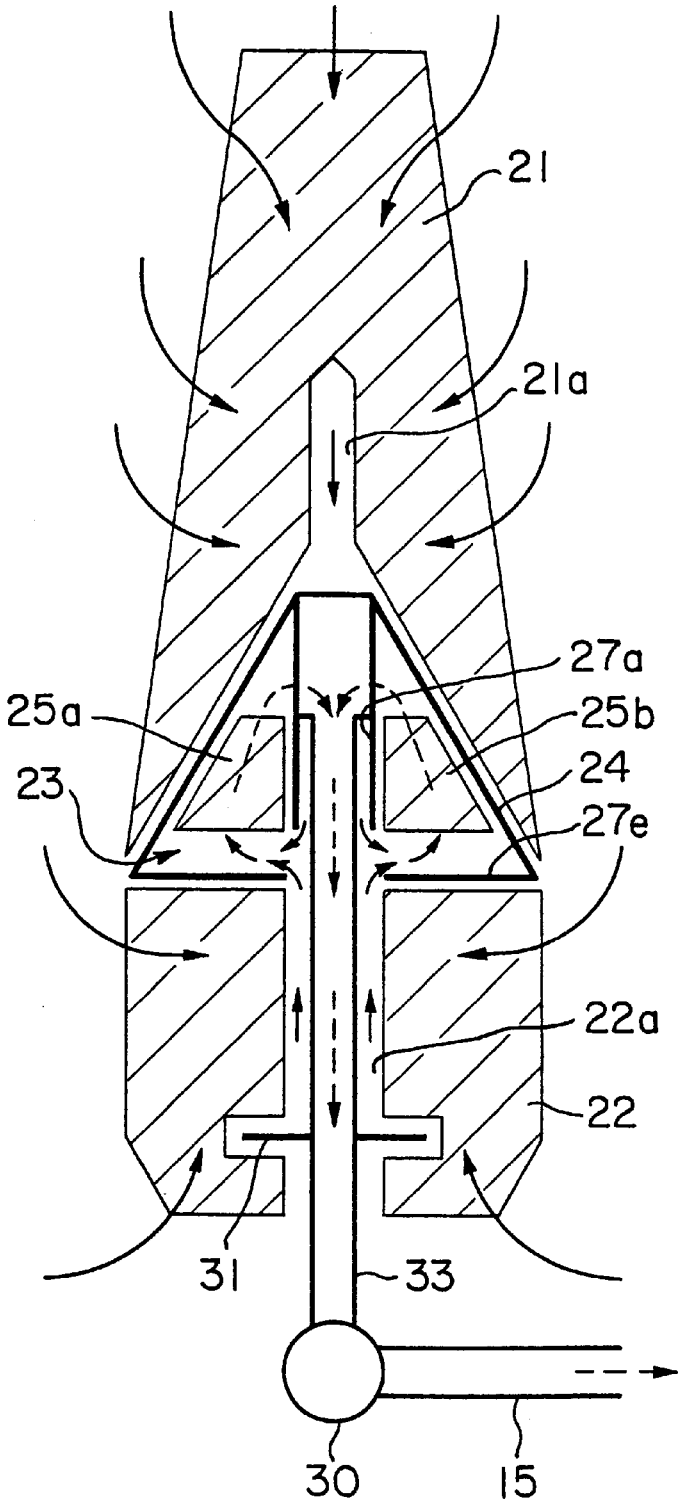
FIG. 7 is a sectional view of a cooling pipe bundle of the condenser according to a fourth embodiment of the present invention.
Figure 8:
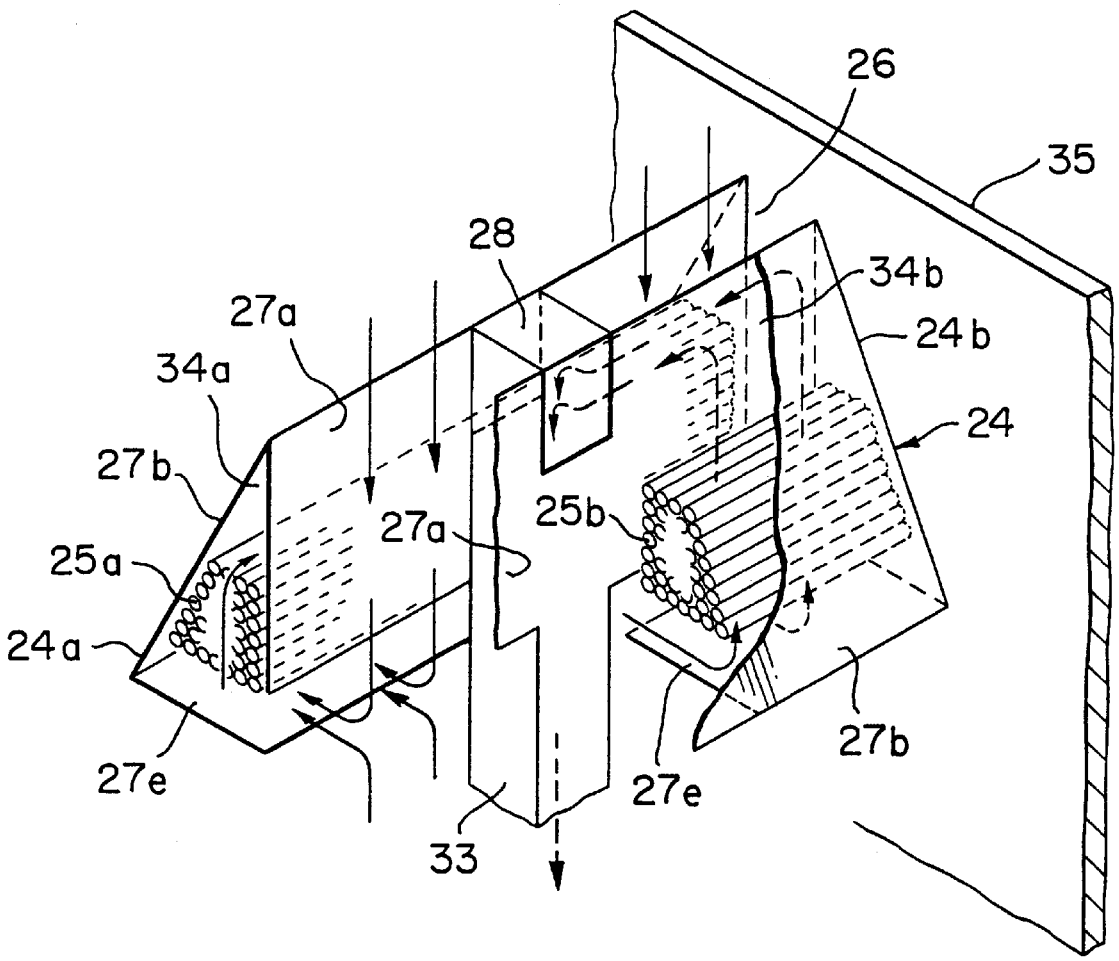
FIG. 8 is a partially broken perspective view of the air cooling portion of FIG. 7.

FIGS. 7 and 8 show the condenser according to a fourth embodiment of the present invention. The present embodiment is different from the first embodiment shown in FIGS. 1 to 4 in that in the former the air exhaust inner pipe is extended downward, and accordingly the respective constituent members and their arrangements are partially changed. In other respects the present embodiment is substantially the same as the first embodiment, and the same parts of the present embodiment as the first embodiment shown in FIGS. 1 to 4 will not be explained.

As shown in FIG. 7, a space 23 is formed in the lower end of an upper cooling pipe bundle 21, and the space 23 reduces its width gradually upward. An upper central space 21*a* is extended upward from the top of the upper central space 23. A lower cooling pipe bundle 22 is bisected horizontally symmetric. A lower central space 22*a* is vertically formed through the lower cooling pipe bundle 22.

An air exhaust inner pipe 33 is vertically inserted through the lower central space 22*a* formed between the surfaces of the bisections of the lower pipe bundle 22 opposed to each other. The air exhaust inner pipe 33 has the top end communicated with a communication passage 28 which communicates air cooling chambers 24*a*, 24*b* with each other and has the lower end communicated with an air exhaust header 30 disposed below the lower pipe bundle 22. An exhaust pipe 15 is communicated with the air exhaust header 30. Short pass preventive plates 31 are provided horizontally outward on both sides of the air exhaust inner pipe 33, projected in the lower pipe bundle 22.

Thus, as in the above-described embodiments, uncondensed gas collected in the upper spaces 34*a*, 34*b* in the respective air cooling chambers 24*a*, 24*b* flows into the air exhaust inner pipe 33 through the communication passage 28, then led into the air exhaust header 30 downward through the air exhaust inner pipe 33, and is discharged to the outside of a body 1 of the condenser through the air exhaust pipe 15. Steam flowing into the lower central space 22*a* from the lower end is restricted in amount by the short pass preventive plates 31, so that pressure difference is retained between the inside and the outside of the cooling pipe bundle 20, and uncondensed gas accumulated in the vicinity of the cooling pipes can be efficiently discharged.

Figure 9:
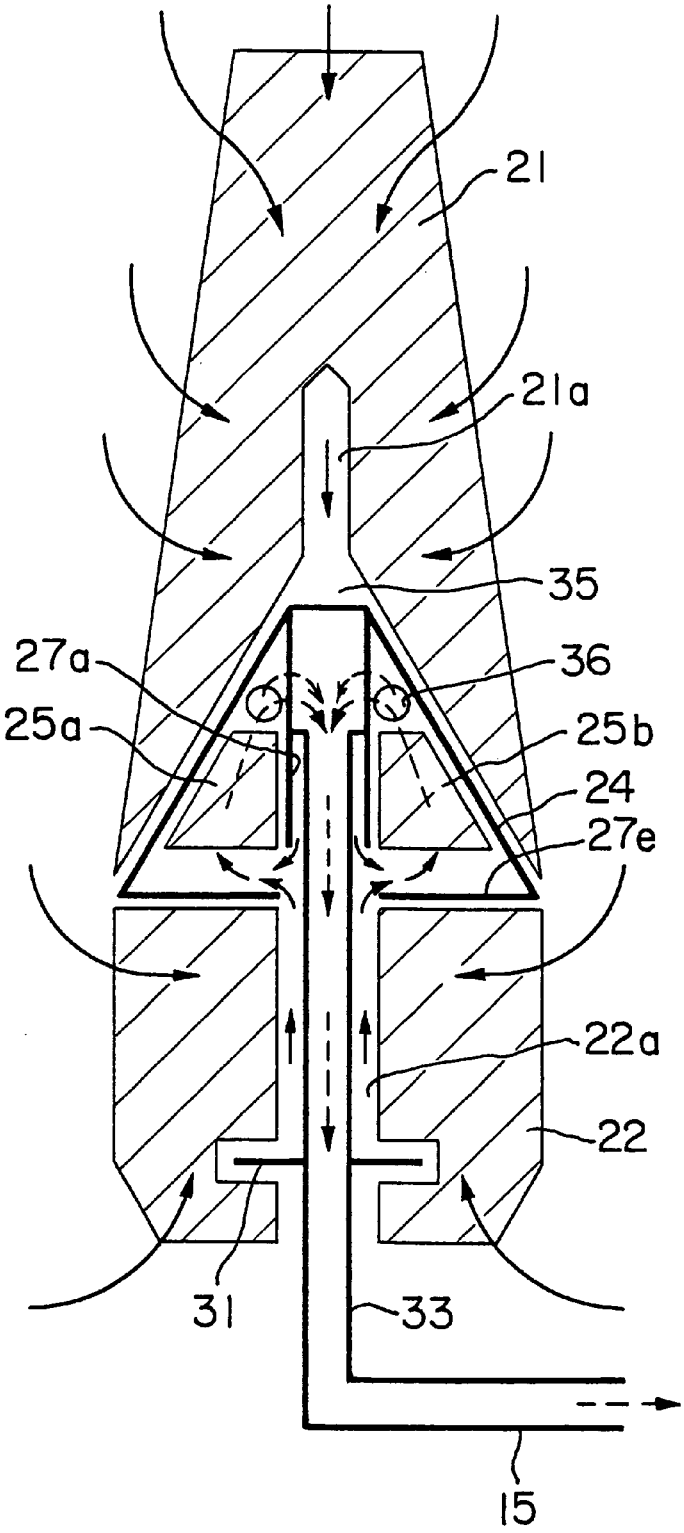
FIG. 9 is a sectional view of a cooling pipe bundle of the condenser according to a fifth embodiment of the present invention.
Figure 10:
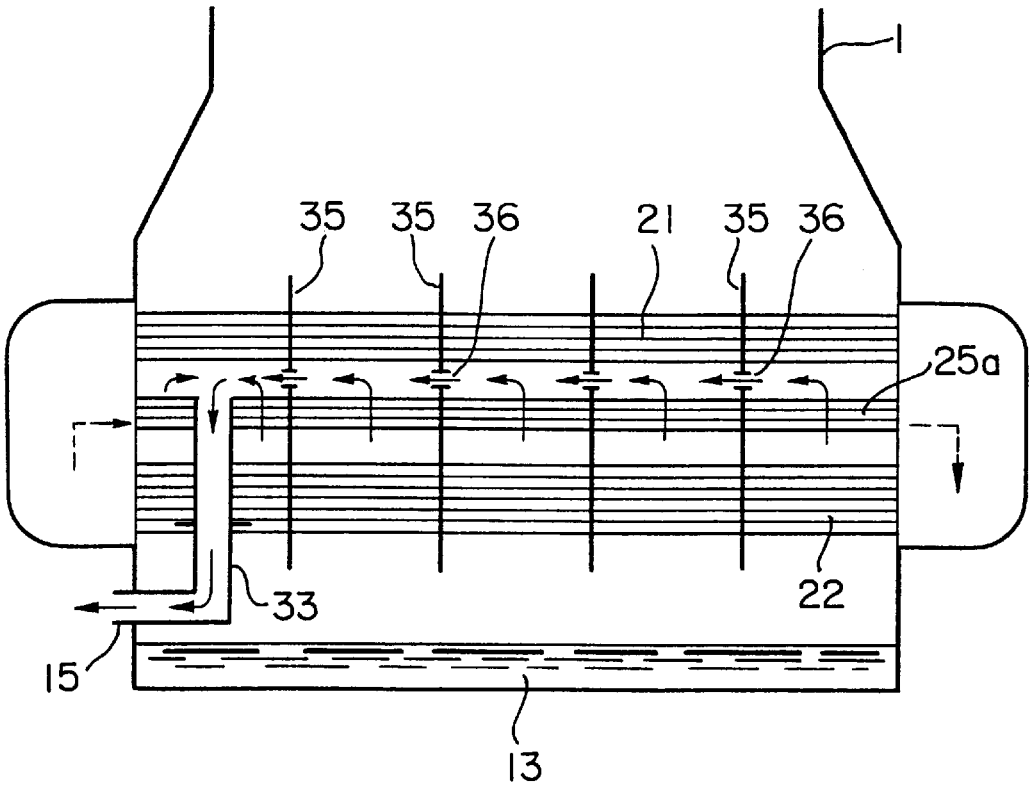
FIG. 10 is a longitudinal sectional view of the condenser according to the fifth embodiment of the present invention, showing a diagrammatic structure.
Figure 11:
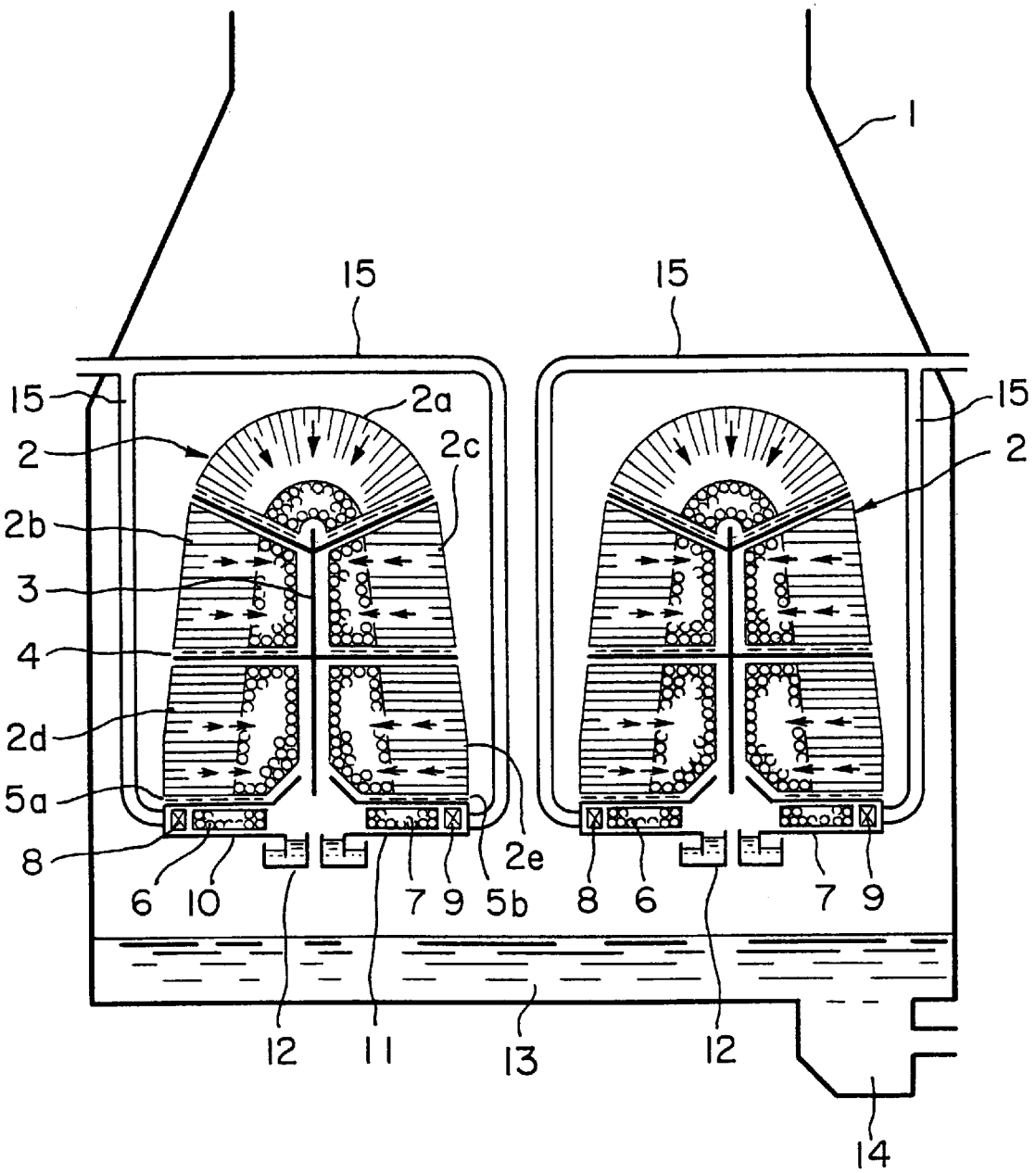
F I G. 11 (PRIOR ART)
FIG. 11 is a vertical sectional view of one example of the conventional condenser.

FIGS. 9 and 10 are views of the condenser according to a fifth embodiment of the present invention.

In the present embodiment, air communication holes 36 are formed in parts of support plates 35 corresponding to the upper spaces 34*a*, 34*b* of the air cooling chambers 24*a*, 24*b*, and the support plates 35 support the air cooling pipe bundles 25*a*, 25*b* and secting the air cooling chambers 24*a*, 24*b*.

As shown in FIG. 10, the air exhaust inner pipe 33 is provided only in the endmost one of the sections divided by the support plates 35. That is, the endmost section has the structure shown in FIG. 9, and the rest sections have the structure with the air exhaust inner pipe 33 omitted. In the sections without the air exhaust inner pipe 33, short pass plates 31 alone are provided for the prevention of short pass of steam, and the short pass preventive plates 31 are supported only by the support plates 35.

In the present embodiment, uncondensed gas generated in the respective sections each between the support plates 35 flows in the longitudinal direction of the cooling pipes through the air communication holes 36 formed in the respective support plates 35 and is discharged to the outside of the condenser through the air exhaust inner pipe 33 in the endmost section. The present embodiment produces the same effects as the rest embodiments. The structure of the present embodiment permits the air exhaust header 30 to be omitted.

What is claimed is:

1. A condenser comprising:

a condenser body;

a first cooling pipe bundle having a number of cooling pipes extending in a first horizontal direction and disposed in the condenser body;

a pair of second cooling pipe bundles, each having a number of cooling pipes extending in the first horizontal direction and disposed at a substantially central part of the first cooling pipe bundle, the second cooling pipe bundles defining a gap therebetween;

a partitioning element defining a pair of air cooling chambers each containing one of the second cooling pipe bundles respectively, the partitioning element defining an upper space above each of the second cooling pipe bundles and a lower space below each of the second cooling pipe bundles in each of the air cooling chambers, the partitioning element including a pair of deflector plates diverging as traveling downward in a second horizontal direction which is perpendicular to the first horizontal direction, wherein the air cooling chambers are defined below the deflector plates respectively, wherein the partitioning element is so disposed that the partitioning element is capable of preventing steam passing through the first cooling pipe bundle from directly intruding into the upper spaces of the air cooling chambers without first passing through the second cooling pipe bundles, and wherein the partitioning element defines a pair of openings for introducing the steam which has passed through the first cooling pipe bundle into the lower spaces of the air cooling chambers respectively; and an air exhaust inner pipe extended vertically in the first cooling pipe bundle, the air exhaust inner pipe having one end communicated with one or both of the upper spaces in the cooling chambers and the other end communicated with the outside of the condenser body.

2. A condenser according to claim 1, wherein the first cooling pipe bundle includes an upper bundle positioned above the deflector plates, the upper bundle being divided into sections with a gap between the sections, and wherein the air exhaust inner pipe extends upward through the gap between the sections of the upper bundle of the first cooling pipe bundle.

3. A condenser according to claim 1, wherein the first cooling pipe bundle includes a lower bundle positioned below the partitioning element, the lower bundle being divided into bisections with a gap between the sections, and wherein the air exhaust inner pipe extends downward through said gap between the bisections of the lower cooling pipe bundle.

4. A condenser according to claim 1, further comprising:

a communication passage for communicating upper spaces in the air cooling chambers with each other; and wherein the air exhaust inner pipe is connected to the communication passage.

5. A condenser according to claim 4, wherein the partitioning element further includes a pair of vertical plates each having an upper end connected to an upper end of each of the deflector plates and defining the pair of air cooling chambers respectively, the vertical plates defining a passage therebetween to allow steam which has passed through the first cooling pipe bundle to pass through the openings;

wherein the communication passage extends in the second horizontal direction and has opposite ends each connected to the vertical plates respectively; and wherein the communication passage is positioned higher than the uppermost portions of the second cooling pipe bundles.

6. A condenser according to claim 2, further comprising:

short pass preventive plates covering the gap between the bisections of the upper bundle of the first cooling pipe bundle and extending into the cooling pipe bundle, wherein the short pass preventive plates prevent steam from directly intruding into a vicinity of the air cooling chambers through the gap between the bisections of the upper bundle of the first cooling pipe bundle.

7. A condenser according to claim 6, wherein the air exhaust inner pipe is extended through the short pass preventive plates.

8. A condenser according to claim 6, further comprising at least one additional air exhaust inner pipe disposed away from the air exhaust inner pipe with respect to the first horizontal direction, the at least one additional air exhaust inner pipe having one end communicated with one or both of the upper spaces in the air cooling chambers; and an air exhaust header disposed at a top end portion of the first cooling pipe bundle and extended horizontally, for communicating the other end of the air exhaust inner pipe and the other end of the at least one additional air exhaust inner pipe; and the short pass preventive plates are provided on both sides of the air exhaust header.

9. A condenser according to claim 3, further comprising:

short pass preventive plates covering the gap between the bisections of the lower bundle of the first cooling pipe bundle and extending into the cooling pipe bundle, wherein the short pass preventive plates prevent steam from directly intruding into a vicinity of the air cooling chambers through the gap between the bisections of the lower bundle of the first cooling pipe bundle.

10. A condenser according to claim 9, wherein the air exhaust inner pipe is extended through the short pass preventive plates.

11. A condenser according to claim 9, further comprising at least one additional air exhaust inner pipe disposed away from the air exhaust inner pipe with respect to the first horizontal direction, the at least one additional air exhaust inner pipe having one end communicated with one or both of the upper spaces in the air cooling chambers; and an air exhaust header disposed at a top end portion of the first cooling pipe bundle and extended horizontally, for communicating the other end of the air exhaust inner pipe and the other end of the at least one additional air exhaust inner pipe; and the short pass preventive plates are provided on both sides of the air exhaust header.

12. A condenser according to claim 1, wherein the partitioning element further includes a pair of vertical plates each having an upper end connected to an upper end of each of the deflector plates and defining the pair of air cooling chambers respectively, the vertical plates defining a passage therebetween to allow steam which has passed through the first cooling pipe bundle to pass through the openings.

13. A condenser according to claim 12, wherein the partitioning element further includes a pair of bottom plates extending horizontally and defining a gap therebetween, each of the bottom plates having an outer end connected to a lower end of each of the deflector plates, each of the bottom plates having an inner end located apart from a lower end of each of the vertical plates so as to define the opening and located apart from each other;

wherein each of the vertical plates covers each of the second cooling pipe bundles as viewed in the second horizontal direction;

wherein the first cooling pipe bundle includes a lower bundle positioned below the pair of bottom plates, and at least an upper portion of the lower bundle is divided into bisections with a gap between the sections, each of the bisections of the lower bundle being located below the bottom plates respectively;

and wherein each of the bottom plates covers each section of the lower bundles respectively as viewed in a vertical direction.

14. A condenser according to claim 1, wherein the partitioning element further comprises a plurality of support plates arranged perpendicular to the first horizontal direction sectioning an inner space of the condenser body into a plurality of sections, the support plates supporting the first cooling pipe bundle and the second cooling pipe bundles, the support plates sectioning the first cooling pipe bundle and the second cooling pipe bundles into plural parts, and wherein plural pairs of the air cooling chambers are provided in plural sections of the inner space of the condenser body respectively.

15. A condenser according to claim 14, wherein said condenser further includes means for communicating upper spaces in the air cooling chambers in their respective sections, and the air exhaust inner pipe is disposed in only one of the plural sections.

* * * * *